US008967409B2

(12) United States Patent
Desiles et al.

(10) Patent No.: US 8,967,409 B2
(45) Date of Patent: Mar. 3, 2015

(54) CAN WITH PARTIAL INTERIOR LACQUERING, METHOD AND DEVICE FOR MANUFACTURING THE SAME

(75) Inventors: Bruno Desiles, La Fleche (FR); Franck Philippe Dathy, Le Mans (FR); Alain Marcel Le Talludec, Lezigne (FR); Phabet Chhim, Le Mans (FR)

(73) Assignee: Ardagh MP Group Netherlands B.V., Deventer (NL)

( * ) Notice: Subject to any disclaimer, the term of this patent is extended or adjusted under 35 U.S.C. 154(b) by 1116 days.

(21) Appl. No.: 12/863,888

(22) PCT Filed: Jan. 23, 2009

(86) PCT No.: PCT/EP2009/050769

§ 371 (c)(1), (2), (4) Date: Jul. 21, 2010

(87) PCT Pub. No.: WO2009/092786

PCT Pub. Date: Jul. 30, 2009

(65) Prior Publication Data

US 2010/0307953 A1 Dec. 9, 2010

(30) Foreign Application Priority Data

Jan. 25, 2008 (EP) ..... 08300053

(51) Int. Cl.
*B65D 1/40* (2006.01)
*B65D 1/16* (2006.01)
*B05B 13/06* (2006.01)
(Continued)

(52) U.S. Cl.
CPC ..... *B65D 1/165* (2013.01); *B05B 13/0618* (2013.01); *B05B 13/0681* (2013.01);
(Continued)

(58) Field of Classification Search
USPC ..... 220/62.13, 604, 669, 917; 426/131, 426/133; 206/524.3, 524.6, 524.9, 524.5; 427/233, 231, 236, 234
See application file for complete search history.

(56) References Cited

U.S. PATENT DOCUMENTS 1,811,160 A * 6/1931 Stevenson ..... 220/62.13
3,687,334 A * 8/1972 McNeil ..... 220/795
(Continued)

FOREIGN PATENT DOCUMENTS

| | | |
|---|---|---|
| EP | 0 688 615 | 12/1995 |
| JP | 52 037170 | 3/1977 |
| WO | WO 01/51222 | 7/2001 |

OTHER PUBLICATIONS

International Search Report, PCT/EP2009/050769, May 29, 2009.

*Primary Examiner* — Jacob K Ackun
*Assistant Examiner* — Jenine Pagan
(74) *Attorney, Agent, or Firm* — Young & Thompson

(57) ABSTRACT

A can (1), in particular for conditioning foodstuff, includes a body composed of a bottom element (2) which is prolonged by a lateral wall (3), the interior surface (9) of the body being at least in part made of tin, the tin surface (9) being partially covered with a coat of protective lacquer (10) to prevent the contact between the tin surface (9) and the foodstuff, the lacquerless tin surface, the "exposed", being intended to come into contact with the foodstuff in order to set free the tin. The exposed tin surface is constituted of a plurality of "exposed" tin zones (11), which are separated, ones from the others, by lacquered zones (12), the exposed tin zones (11) being distributed on the height of the lateral wall (3), in particular to limit the aesthetic impact due to chemical action of the foodstuff on the exposed tin zones (11).

4 Claims, 2 Drawing Sheets

(51) Int. Cl.

| | |
|---|---|
| ***B65D 1/44*** | (2006.01) |
| ***B65D 25/14*** | (2006.01) |
| *B05D 1/02* | (2006.01) |
| *B05D 1/32* | (2006.01) |
| *B05D 7/22* | (2006.01) |

(52) U.S. Cl.

CPC ..... *B05B13/069* (2013.01); *B65D 1/44* (2013.01); *B65D 25/14* (2013.01); *B05D 1/02* (2013.01); *B05D 1/32* (2013.01); *B05D 7/227* (2013.01)

USPC ..... 220/62.13; 220/669; 426/131; 426/133; 206/524.3

(56) References Cited

U.S. PATENT DOCUMENTS

| | | | | | |
|---|---|---|---|---|---|
| 3,784,048 | A | * | 1/1974 | McKernan | 220/270 |
| 3,888,224 | A | * | 6/1975 | Okuhara et al. | 426/126 |
| 3,947,617 | A | * | 3/1976 | Gerek et al. | 220/62.12 |
| 4,054,227 | A | * | 10/1977 | Saunders | 220/62.13 |
| 4,459,793 | A | * | 7/1984 | Zenger | 53/434 |
| 5,575,400 | A | * | 11/1996 | Turner et al. | 220/62.11 |
| 5,593,063 | A | * | 1/1997 | Claydon et al. | 220/608 |
| 2003/0121793 | A1 | | 7/2003 | Groeger et al. | |

* cited by examiner

CAN WITH PARTIAL INTERIOR LACQUERING, METHOD AND DEVICE FOR MANUFACTURING THE SAME

The invention relates to a can particularly for conditioning foodstuff, of which the interior surface is made at least in part of tin and is partially coated with a protective lacquer. This invention also relates to a process of manufacturing such a can, and a device to implement said process.

BACKGROUND OF THE INVENTION

Certain foodstuffs, such as fruits or products containing tomato, are usually packed in cans having an inner surface made at least in part of tin.

During thermal processing and also subsequent storage, the packed product takes up a certain amount of the tincoating, which preserves the organoleptic and visual properties of the product by minimising oxidation phenomenon.

To control the amount of tin available to the product packed therein, it is known to coat partially the inner tin surface of the cans with a suitable protective lacquer (also said protective varnish or coating).

Such partially lacquered cans are for example disclosed in documents EP-0 492 870 or EP-0 688 615.

In these documents, the can body is made from a tinplate, by drawing operation. The can obtained comprises a bottom element and a lateral wall which extends from the periphery of said bottom element; the upper border of said lateral wall defines an upper opening of the body intended to receive closing means.

The can body comprises a unique lacquered surface, which extends continuously along a part of the height of the interior surface of its lateral wall; more precisely, said protective lacquered zone extends, in a continuous manner, from the upper border of the lateral wall and less than its length. The rest of the lateral wall (here its bottom) forms a unique exposed tin zone.

However, this type of current partially lacquered cans is not totally satisfying, since the inner surface of its side wall presents generally a blackened part which is particularly not aesthetic for the final consumer.

This blackened part corresponds to the exposed tin surface which contrasts with the lacquered zone of the lateral wall (which is generally particularly of light or clear colour); this blackening phenomenon is due to the chemical reaction with the conditioned foodstuff.

SUMMARY OF THE INVENTION

Starting from this problem, the applicant has developed a new can, particularly for conditioning foodstuff, whereof the inner surface presents a particular coating of lacquer which limits, and even suppress, the impact of the lacquerless tin surface on the general aesthetic aspect of the inner surface of the can, while allowing the optimal delivery of tin to preserve the qualitative characteristics of the packed foodstuff.

The can according to the invention is of the type comprising a body composed of a bottom element which is prolonged by a lateral wall whereof the upper border defines an upper opening intended to receive a closure mean, the interior surface of said body being at least in part made of tin, said tin surface being partially covered with a coating of protective lacquer to prevent the contact between said tin surface and said foodstuff, the lacquerless tin surface, said "exposed", being intended to come into contact with the foodstuff in order to set free said tin. According to the invention, said exposed tin surface is constituted of a plurality of "exposed" tin zones, which are separated, ones from the others, by lacquered zones, said exposed tin zones being distributed on the height of said lateral wall.

This particular can limits, and even suppress, the impact of the lacquerless tin surface on the aesthetic aspect of the inner surface of the can (by dividing the exposed tin surface in a plurality of exposed tin zones), while allowing the optimal delivery of tin to preserve the qualitative characteristics of the packed foodstuff.

According to a preferred embodiment, the exposed tin zones are distributed homogeneously, or quasi-homogeneously, on said tin surface.

This particular distribution allows in particular an optimal delivery of tin, on the whole height of the foodstuff.

According to another characteristic, the tin surface comprises an alternation of lacquered zones and exposed tin zones, said zones having each a general shape of band, and said zones being distributed on at least a part of the height of the lateral wall and being arranged according plans perpendicular to the longitudinal axis of the body of can.

According to another characteristic and in the case of a lateral wall having at least a bead of which the interior surface is at least in part made of tin, said bead comprises an exposed tin zone on at least a part of its surface.

According to a preferred embodiment of this case and in which at least some of the beads have part said "hidden", oriented towards the bottom element of said can, the exposed tin zone of said beads are arranged mainly at their said hidden part, the rest of the surface of said beads corresponding to lacquered zones.

This particular arrangement of the exposed tin zone allows its optimal hiding to the final consumer, which optimize the visual aesthetic of the inner surface of the can.

Also according this case, the beads have advantageously a curved shape, extending alternatively in a convex and a concave manners (towards the inside and the outside respectively), and the "hidden" part of said concave beads, oriented towards the bottom element of said can, comprising an exposed tin zone.

Always according this case, the beads extends advantageously on the circumference of the lateral wall, and the associated exposed tin zones are advantageously of annular band shape.

Also according this case, the exposed tin zone, arranged on the bead, forms advantageously between 5% to 50% of the total surface of said bead.

The present invention also relates to a process to manufacture a can for conditioning foodstuff, said process comprising at least a step of coating the interior surface of the lateral wall with a protective lacquer by using coating means.

The said coating step consists in coating the interior surface of said lateral wall with the protective lacquer such as to form a plurality of "exposed" tin zones, which are separated, ones from the others, by lacquered zones, said exposed tin zones being distributed on the height of said lateral wall.

According to a particular embodiment, during the coating step, the can and/or the sprayer nozzle are operated in longitudinal translation and/or in rotation, one relative to the other, according to the longitudinal axis of said can.

According to another particular embodiment in which said can has a lateral wall comprising at least one bead and in which said coating means comprise at least one sprayer nozzle, said sprayer nozzle is positioned, during the coating step, in front of the upper opening of the can, outside the interior volume defined by the lateral wall, and sprays the protective lacquer towards said lateral wall of the can.

According to this last particular embodiment, the can and/or the spraying nozzle are advantageously operated in longitudinal translation one relative to the other, the spray of protective lacquer being arranged so that its upper edge forms an angle B with the lateral wall which is inferior to 90°.

According to another particular embodiment in which said coating mean comprises at least one sprayer nozzle, the exposed tin zones are advantageously obtained by mean of a preset timing cycle of spray opening and closure, according to the relative position between the can and the nozzle.

The present invention also relates to a device to manufacture a can in particular for conditioning foodstuff and/or to implement the above-mentioned process, in which said device comprises at least a coating unit equipped of coating means to coat the interior surface of the lateral wall of said can with a protective lacquer.

The said coating means are structure to coat the interior surface of said lateral wall with the protective lacquer such as to form a plurality of "exposed" tin zones, which are separated, ones from the others, by lacquered zones, said exposed tin zones being distributed on the height of said lateral wall.

According to a preferred embodiment, the coating means comprise at least a sprayer nozzle which, in spraying position, is advantageously arranged in front of the upper opening of said can, outside of the interior volume defined by said lateral wall, said sprayer nozzle being arranged to spray the protective lacquer towards the interior surface of said lateral wall of the body of can, to form the exposed tin zones.

According to a particular embodiment, the sprayer nozzle is arranged in order that the spray of protective lacquer is arranged so that its upper edge forms an angle with the lateral wall which is inferior to 90°.

BRIEF DESCRIPTION OF THE DRAWINGS

The invention is also disclosed, without being limited, by the following specification according to the annexed drawing in which.

DETAILED DESCRIPTION OF THE PREFERRED EMBODIMENTS

Figure 1:
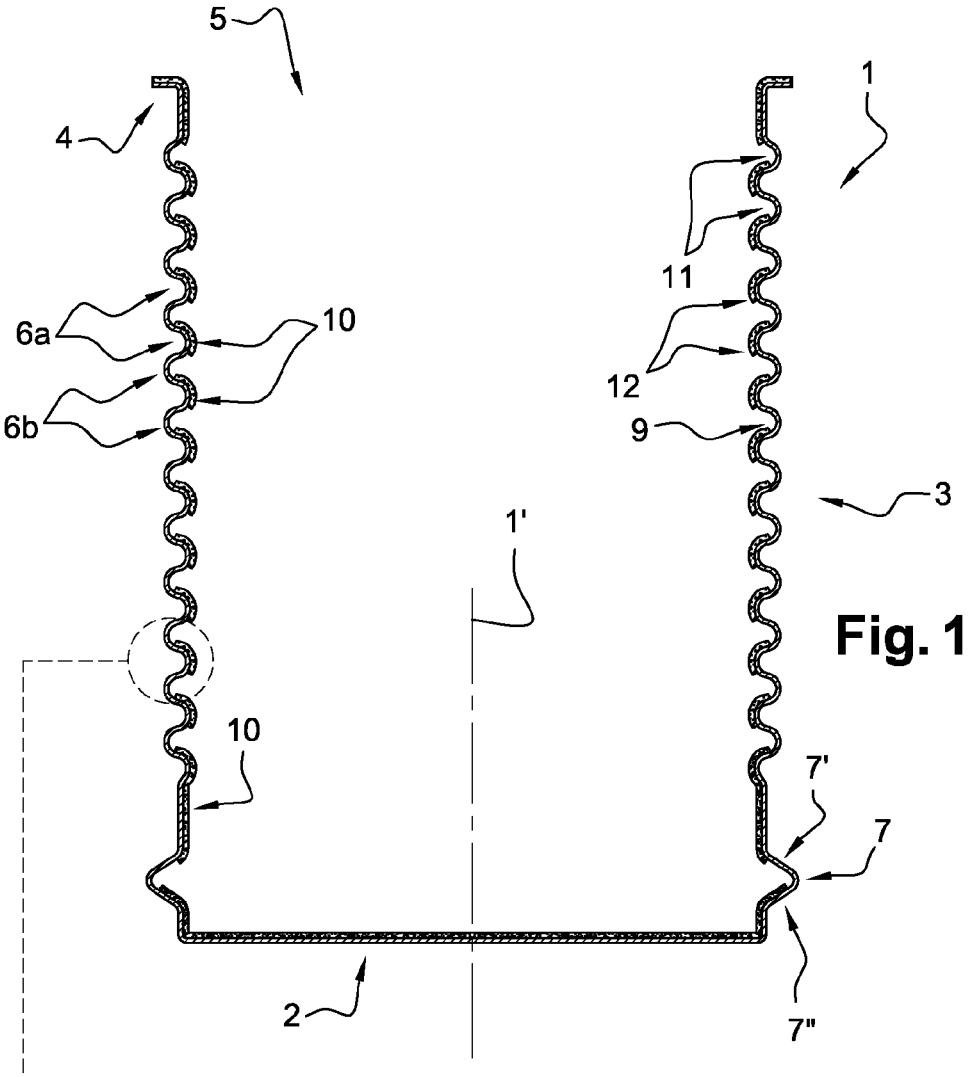
FIG. 1 is a schematic sectional view of a beaded can according to the invention, the lacquer coating being represented also in a schematic manner.

The can 1 according to the invention, as shown FIG. 1, is composed of a bottom wall 2, for example circular, from the periphery of which extends a lateral wall 3, for example of a cylindrical shape.

The upper border 4 of said lateral wall 3 defines an upper opening 5 through which the foodstuff (not represented) is usually introduced into the can. This upper border 4 is also intended to receive a closing mean (not represented).

The bottom wall 2 and the lateral wall 3 can be made in one piece. These two elements 2, 3 can also be associated by any suitable operation.

Figure 2:
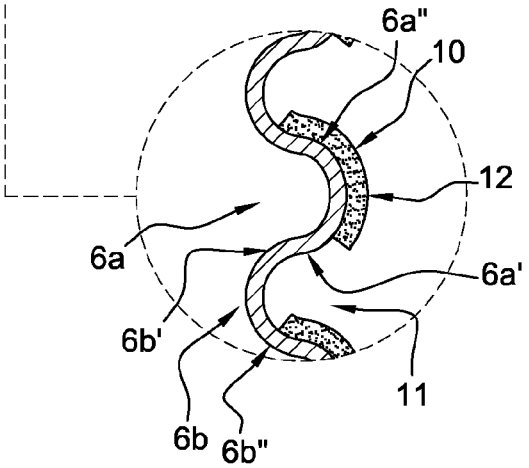
FIG. 2 is an enlarged view of a part of the lateral wall of the can represented FIG. 1, in order to schematically show the particular coating of the beads.

As shown FIGS. 1 and 2, the lateral wall 3 has a plurality of beads 6, 7 which are here arranged on the main part of its height.

These beads 6, 7 are here of an annular type (extending on the whole circumference of the lateral wall 3); in an alternative embodiment, they can also be of discontinuous or punctual type.

These beads 6, 7 can be obtained by a usual beading operation.

The most of said beads 6 are identical and of a general half-circular shape. They extend alternatively in a convex and a concave manner, i.e. respectively towards inside (named 6*a*) and outside (named 6*b*) compare to the general surface of the lateral wall 3.

This type of beads 6 is usually used to increase the lateral resistance of the can.

The lateral wall 3 comprises also a lower terminal bead 7, which has for example a V type concave shape which lay laterally.

These beads 6, 7 have each—a first part 6', 7', oriented towards the bottom element 2 of said can 1, and—a second part 6", 7", oriented towards the upper opening 5 of said can 1. More precisely, the first part 6*b*', 7' and second part 6*b*", 7" of each concave bead 6*b* and 7, correspond respectively to the upper and lower parts of said bead. This is the contrary for the convex beads 6*a*, whereof the first part 6*a*' and second part 6*a*" correspond respectively to their lower and upper parts.

The can 1 is advantageously made of a steel matrix whereof the inner surface 9, and at least the inner surface of its lateral wall 3, has a coating of tin and/or tin alloy.

This inner tin surface 9 of the lateral beaded wall 3 is only partially coated with a protective lacquer 10. The bottom wall 2 is lacquered, but it can also be lacquerless or partially lacquerless.

The aim of this tin surface partially lacquered, as previously mentioned, is to be at least in part in contact with the conditioned foodstuff, in order to deliver a certain amount of tin into said foodstuff.

The type of lacquer used, and its thickness, can be chosen by one skill in the art, in particular function of the foodstuff packed.

According to the invention, the partial lacquer of the height of the lateral wall 3, and as a result at its exposed tin surface 9, is arranged to form an alternation of exposed tin zones 11 (also named without lacquer/lacquerless tin zones) and lacquered tin zones 12.

These exposed zones 11 and lacquered zones 12 are each in band shape (here annular), extending into a general plan which is perpendicular to the longitudinal axis 1' of the can 1.

This particular distribution of the exposed tin zones 11 has for result to limit their aesthetic impact (darkened due to oxidation by foodstuff), but also to provide a delivery of tin on the whole height of the packed foodstuff (to allow a distribution nearly homogenous of the tin).

Moreover the exposed tin zones 11 are here arranged and positioned in order to reduce even more their aesthetic impact, by taking advantage of the presence of the beads 6, 7 above described.

To this aim, as shown FIGS. 1 and 2, the exposed tin zones 11 are arranged at least on a part of the upper part 6*b*' of the concave beads 6*b* (oriented towards the bottom wall 2 of the can); these exposed tin zones 11 can also extend partially on the lower part 6*b*" of said concave beads 6*b* (oriented towards the upper opening 5 of the can).

In other words, at least a part of said tin zones 11 extends nearly in the "shadow" of the convex overlying bead 6*a* (viewed from the upper opening 5). These exposed tin zones 11 are arranged as more as possible on the bead sides which are not visually accessible, or hardly visually accessible, from the upper opening 5.

The said convex beads 6*a* are here partially lacquerless on their lower part 6*a*'. In an alternative embodiment, these convex beads 6*a* can be fully lacquered.

Moreover, concerning the terminal bead 7, the exposed tin zone 11 is arranged at its upper part 7'; its lower part 7" corresponds to a lacquered zone 12.

In particular, the exposed tin zone represents advantageously between 5% and 50% of each concave beads 6*b*, 7.

To be complete, the non-beaded part of the lateral wall 3 is here fully lacquered.

In an alternative embodiment, this non-beaded part of the lateral wall 3 could also be provided with exposed tin zones.

Figure 3:
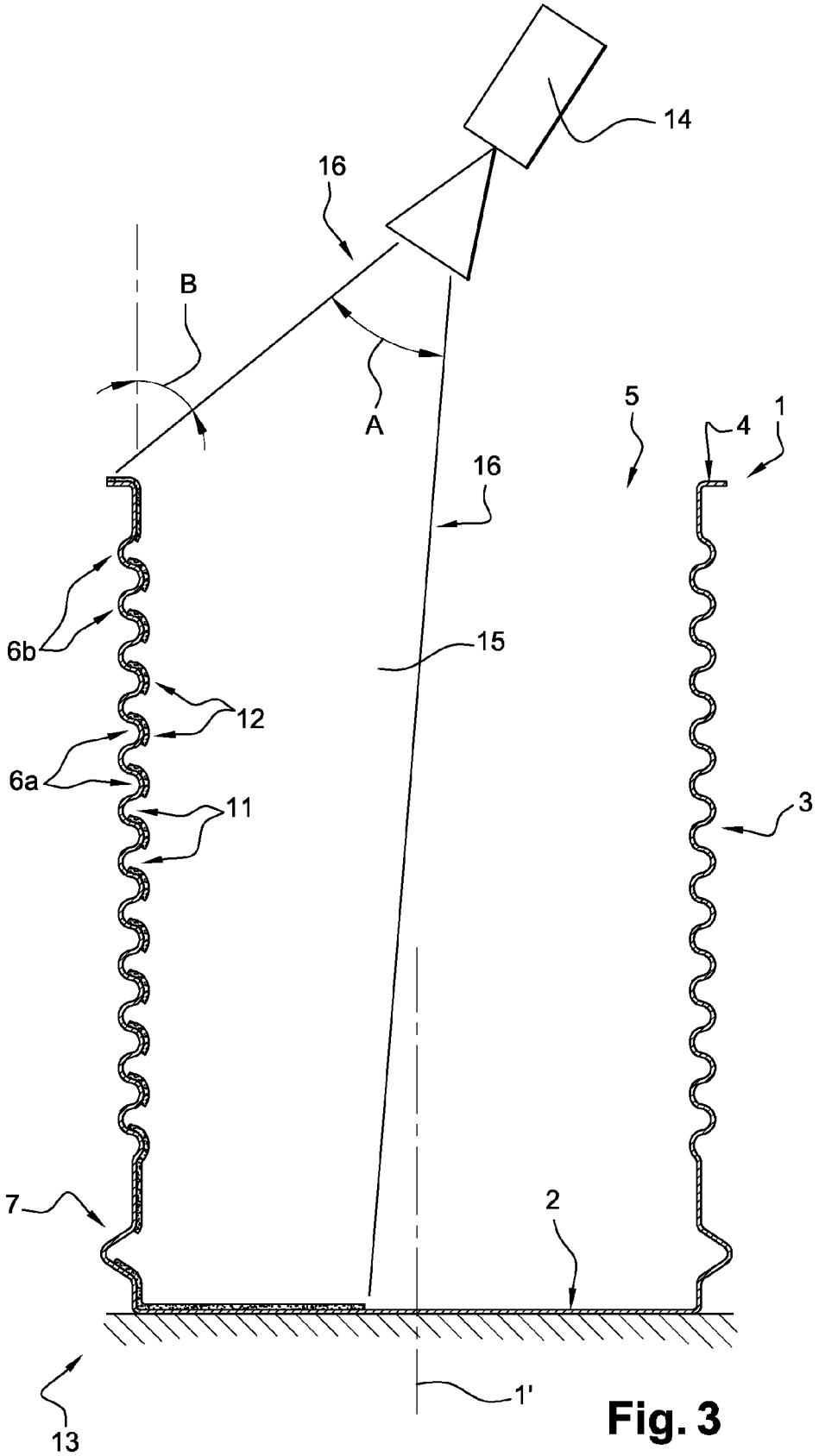
FIG. 3 shows the can according to FIG. 1, associated with a sprayer nozzle suitably arranged to partially lacquer its inner surface.

Such a particular pattern of lacquer coating is obtainable for example by mean of a device as described here-under according to FIG. 3.

This particular device, only partially shown FIG. 3, comprises a coating unit equipped with a support element 13, receiving the can 1 as described above, and a sprayer nozzle 14 suitable to apply the protective lacquer 10 onto the inner surface of can.

As shown FIG. 3, the spray is advantageously arranged in front of the upper opening 5 of the can, outside of the volume defined by the lateral wall 3 (above the upper border 4).

This nozzle 14 is arranged to generate a spray jet 15 which here hits at least the lateral wall 3, and here also a part of the bottom wall 2.

The said spray jet 15 is here in shape of a thin film which extends in a general vertical plan. In alternative modes, this spray jet 15 could also be in the general shape of a cone or a crown.

This spray jet 15 is defined particularly by two outer edges 16 which delimit the vertical spraying angle A of said nozzle 14.

The position of the nozzle 14 relative to the longitudinal axis 1' of the can, and the angle B which is formed between the outer edge(s) 16 of the spraying jet 14 and the lateral wall 3, are arranged to control the amount of exposed tin zones generated on the beads 6, 7.

As shown FIG. 3, the nozzle 14 is arranged on the longitudinal axis 1' of the can 1, or nearly on this longitudinal axis. Moreover, the outer edge 16 of the spraying jet 15 forms an angle B inferior to 90° with said lateral wall 3.

In practice, during the coating step, the sprayer nozzle 14 applies the lacquer 10 towards the inner surface 9 of the lateral wall 3.

In the same time, the can 1 is operated in rotation around its longitudinal axis 1', the sprayer nozzle 14 remaining fixed. This rotation of the can 1 allows the lacquering of the whole circumference of its lateral wall 3.

In an alternative embodiment, it is the nozzle 14 which is operated in rotation.

Also during this coating step, the sprayer nozzle 14 could be moved in translation into the interior volume defined by the lateral wall 3.

In another embodiment, the exposed tin zones are obtained by mean of a preset timing cycle of spray opening and closure according to the relative position between the can and the nozzle.

As above-mentioned, the particular spraying orientation allows the lacquering of only the lateral wall surface which is in regard of the nozzle, i.e. mainly the surface which is hit by the spraying jet. This hit surface corresponds to the lacquered zones 12 of the can previously described according to FIGS. 1 and 2.

The zones of the lateral wall surface which are not hit by the spraying jet correspond then to the exposed tin zones 11.

The can obtained is then the same as the one described above according to FIGS. 1 and 2.

In an alternative embodiment, the coating means of the device could also consist for example in a suitable brush, brush pat, sponge and/or a roller.

These coating means are suitably operated to obtain the particular lacquered pattern above-described.

In general words, the can according to the invention presents an inner surface which is partially lacquered. The exposed tin zones are arranged on the hiding part of the beads, which even more limit their visual impact. Moreover, the exposed tin zones are distributed on the height of the lateral wall which permits a better distribution of tin into the foodstuff.

The invention claimed is:

1. A can for conditioning foodstuff, comprising:

a body composed of a bottom element (2) which is prolonged by a lateral wall (3) of which an upper border (4) defines an upper opening (5) configured to receive a closure, an interior surface (9) of said body being at least in part made of tin, said tin surface (9) having a first portion being covered with a coating of protective lacquer (10) to prevent contact between said tin surface (9) and said foodstuff, and also having a second, exposed portion that is free of lacquer, said exposed portion of the tin surface being intended to come into contact with the foodstuff, wherein said exposed portion of the tin surface is constituted of a plurality of exposed tin zones (11), which are separated from each other by lacquered zones (12) of the first portion of the tin surface, said exposed tin zones (11) being distributed on a height of said lateral wall (3)

wherein the tin surface (9) comprises an alternation of the lacquered zones (12) and the exposed tin zones (11), each of said lacquered and exposed tin zones (11, 12) shaped as a band, and said lacquered and exposed tin zones (11, 12) being distributed on at least a part of the height of the lateral wall (3), wherein the lateral wall (3) comprises one or more beads (6, 7), the interior surface (9) is at least in part made of tin, and said beads (6, 7) comprise an exposed tin zone (11) which is arranged on at least a part of a surface of the beads (6, 7), and wherein at least some of the beads (6, 7) have a part (6', 7') oriented towards a bottom element (2) of said can, said part (6', 7') being free of lacquer, and a remaining portion of the surface of said beads (6, 7) are lacquer-coated.

2. The can for conditioning foodstuff according to claim 1, wherein at least some of the beads (6) have a curved shape, extending alternatively in a convex and a concave manner, and wherein a part (6*b*') of said beads curved in a concave manner (6*b*) oriented towards a bottom element (2) of said can (1) are free of lacquer.

3. The can for conditioning foodstuff according to claim 1, wherein the beads (6, 7) extend in an annular shape on the circumference of the lateral wall (3), and wherein the associated exposed tin zones (11) are of annular band shape.

4. The can for conditioning foodstuff according to claim 1, wherein the exposed tin zone (11), arranged on the beads (6, 7), is between 5% to 50% of the total surface of said beads.

* * * * *